US009657431B2

(12) United States Patent
Kim et al.

(10) Patent No.: US 9,657,431 B2
(45) Date of Patent: May 23, 2017

(54) LAUNDRY TREATING APPARATUS HAVING CLEANING DEVICE

(71) Applicant: LG ELECTRONICS INC., Seoul (KR)

(72) Inventors: Seonghwan Kim, Seoul (KR); Bio Park, Seoul (KR); Yongju Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 628 days.

(21) Appl. No.: 14/057,195

(22) Filed: Oct. 18, 2013

(65) Prior Publication Data

US 2014/0109427 A1 Apr. 24, 2014

(30) Foreign Application Priority Data

Oct. 22, 2012 (KR) ..... 10-2012-0117473

(51) Int. Cl.

| | |
|---|---|
| ***D06F 58/22*** | (2006.01) |
| ***D06F 58/24*** | (2006.01) |
| ***F28G 1/10*** | (2006.01) |
| ***F28G 1/02*** | (2006.01) |
| *D06F 58/20* | (2006.01) |

(52) U.S. Cl.

CPC ..... *D06F 58/22* (2013.01); *D06F 58/206* (2013.01); *D06F 58/24* (2013.01); *F28G 1/02* (2013.01); *F28G 1/10* (2013.01)

(58) Field of Classification Search

CPC ..... D06F 58/22; D06F 58/24; D06F 58/206; F28G 1/00; F28G 1/02; F28G 1/08; F28G 1/10; F28G 3/02; F28G 3/04; F28G 3/10; F28G 3/12

USPC ..... 165/95; 15/104.03, 104.04

See application file for complete search history.

(56) References Cited

U.S. PATENT DOCUMENTS 849,898 A * 4/1907 Hay ..... F28G 7/00 122/379

5,211,028 A * 5/1993 Remo ..... F28G 1/02 165/95

(Continued)

FOREIGN PATENT DOCUMENTS

CN 101563495 A 10/2009

DE 42 12 965 A1 10/1993

(Continued)

OTHER PUBLICATIONS

Partial English Machine Translation: DE 10116238: Accessed Jan. 2017.*

(Continued)

*Primary Examiner* — Kenneth Rinehart

*Assistant Examiner* — Tavia Sullens

(74) *Attorney, Agent, or Firm* — KED & Associates, LLP

(57) ABSTRACT

A laundry treating apparatus may include a cabinet, a drum rotatably installed in the cabinet, a heat exchanger disposed in the cabinet and receiving air from the drum, and a cleaning device disposed in the cabinet and moved by an external force in a first direction to remove lint accumulated on the heat exchanger. The lint may be simply removed from the heat exchanger and air may smoothly flow through the heat exchanger, thus improving performance of the laundry treating apparatus.

16 Claims, 14 Drawing Sheets

(56) References Cited

U.S. PATENT DOCUMENTS

| | | | | |
|---|---|---|---|---|
| 6,041,612 | A * | 3/2000 | Stringer | F28G 1/02 165/95 |
| 8,266,815 | B2 * | 9/2012 | Goldberg | D06F 58/24 34/90 |
| 2010/0146809 | A1 | 6/2010 | Grunert et al. | 34/443 |
| 2010/0223741 | A1 | 9/2010 | Grunert | |

FOREIGN PATENT DOCUMENTS

| | | | | |
|---|---|---|---|---|
| DE | 100 02 742 | | 6/2001 | |
| DE | 101 16 238 | | 3/2005 | |
| DE | 20 2006 018 205 | | 2/2007 | |
| DE | 10 2006 006 080 | A1 | 8/2007 | |
| DE | 10 2006 018 469 | A1 | 10/2007 | |
| DE | 10 2006 050 877 | A1 | 4/2008 | |
| EP | 0 468 573 | | 1/1992 | |
| KR | 10-2004-0077338 | A | 9/2004 | |
| NL | EP 0468573 | A1 * | 1/1992 | D06F 58/24 |

OTHER PUBLICATIONS

Partial English Machine Translation: DE 10002742: Accessed Jan. 2017.*

Chinese Office Action issued in Application No. 201310492164.6 dated Jun. 3, 2015.

United Kingdom Combined Search and Examination Report dated Jan. 29, 2014 , issued in Application No. GB1318540.0.

French Search Report dated Jun. 24, 2016 issued in Application No. 1360140 (Original Search Report with English Translation).

German Office Action dated Sep. 27, 2016 issued in Application No. 10 2013 111 493.8. (English translation attached).

* cited by examiner

LAUNDRY TREATING APPARATUS HAVING CLEANING DEVICE

CROSS-REFERENCE TO RELATED APPLICATION(S)

This application claims priority under 35 U.S.C. §119 to Korean Application No. 10-2012-0117473 filed on Oct. 22, 2012, whose entire disclosure is hereby incorporated by reference.

BACKGROUND

1. Field

This relates to a laundry apparatus, and particularly, to a laundry treating apparatus capable of removing debris from a heat exchanger installed therein.

2. Background

A laundry treating apparatus may perform, for example, washing, dehydrating and drying functions. Such an apparatus may include, for example, a dryer may receive wet laundry in a drum and evaporate moisture from the laundry using hot air. The moist air discharged from the drum of such a dryer may be hot and humid. Dryers may be classified, according to how this hot humid air is processed, into a condensing type dryer; in which hot humid air circulates without being discharged from the dryer and undergoes heat-exchange with external air within a condenser such that moisture contained within the hot humid air may be condensed, and an exhaust type dryer, in which hot humid air is discharged directly to the outside of the dryer.

BRIEF DESCRIPTION OF THE DRAWINGS

The embodiments will be described in detail with reference to the following drawings in which like reference numerals refer to like elements wherein:

FIG. 11A is a perspective view of the cleaning device located at an initial position, and FIG. 11B is a perspective view of the cleaning device with a manipulation portion thereof actuated; FIG. 12*a* is a perspective view of the cleaning device located at an initial position, and FIG. 12B is a perspective view of the cleaning device with a manipulation portion thereof actuated.

DETAILED DESCRIPTION

Figure 1:
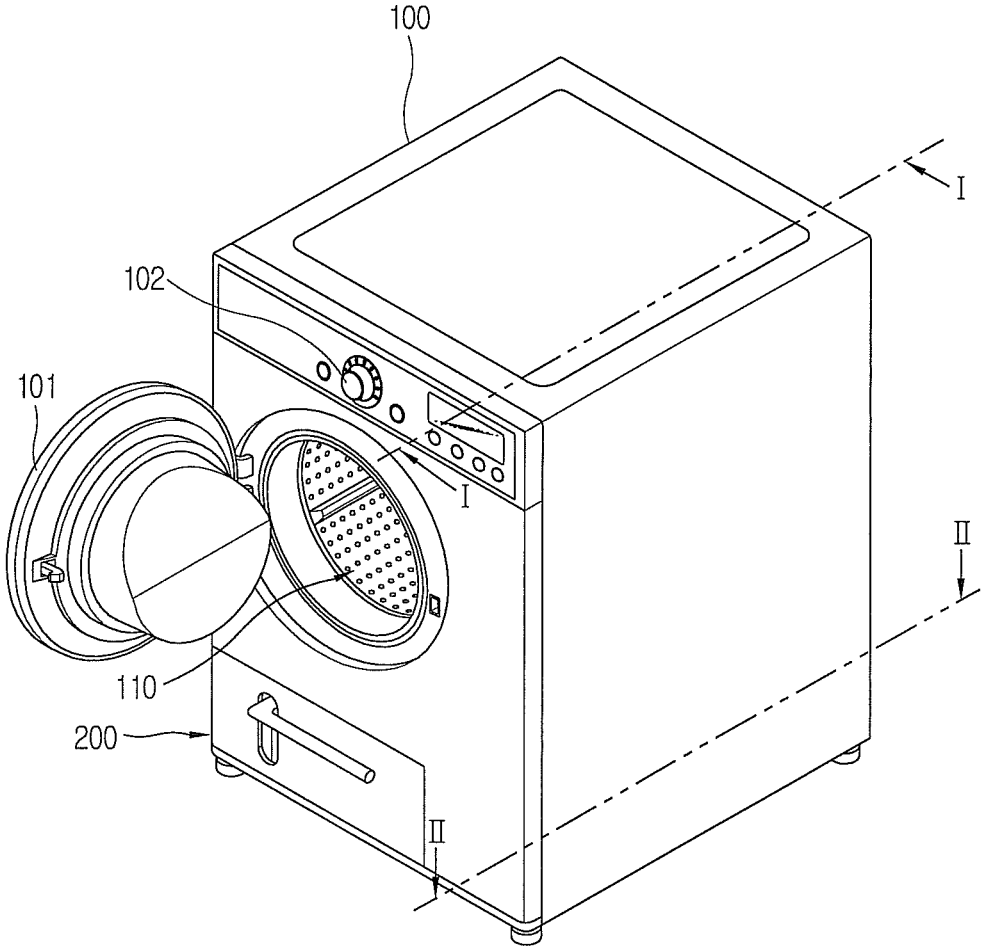
FIG. 1 is a perspective view of a treating apparatus according to an embodiment as broadly described herein.

Hereinafter, various exemplary embodiments will be described in detail with reference to the accompanying drawings, and the same or similar elements will be designated with the same reference numeral wherever possible and their redundant description will be omitted.

The accompanying drawings are provided merely to illustrate and easily explain the various features, and therefore should not be construed as limiting.

When drying laundry in a laundry treatment apparatus, air discharged out of a drum of the apparatus after drying the laundry may contain foreign materials, such as lint. The foreign materials may cause damage while passing through mechanical components of the dryer, or contaminate external air when being discharged to the outside. Therefore, this air may flow through a filter to filter off the foreign materials. However, fine lint or foreign materials may pass through the filter and accumulate on an air inlet of a heat exchanger. When an excess of such foreign materials are collected on the heat exchanger, the foreign materials may interfere with the flow of air passing through the heat exchanger, reducing an amount of air flow and degrading drying performance.

A user may remove accumulated foreign material by opening a cover to access the heat exchanger and using a cleaning tool to remove accumulated lint. However, this method may be somewhat inconvenient, and may generate dust due to separation and coupling of the cover. Alternatively, condensed water generated during a drying process or water supplied from outside of the dryer may be sprayed onto a surface of the heat exchanger on which the lint is accumulated to dislodge the lint. However, a separate spray device and associated control system, and additional installation space may be required to accommodate such a device.

The exemplary embodiment shown in FIGS. 1 to 4 illustrates a dryer, but the present disclosure is not limited to a dryer. The present disclosure may be applicable to any laundry treating apparatus, for example, a washing machine having a drying function, in addition to a washing function, so as to dry laundry by supplying hot air into a drum.

A laundry treating apparatus in accordance with one exemplary embodiment may include a cabinet 100, and a drum 110 installed in the cabinet 100. An introduction opening through which laundry may be introduced into the drum 110 may be formed in a front surface of the cabinet 100. A door 101 may open and close the introduction opening. Various manipulation buttons 102 to manipulate the dryer and a display device may be disposed on the cabinet 100.

Figure 2:
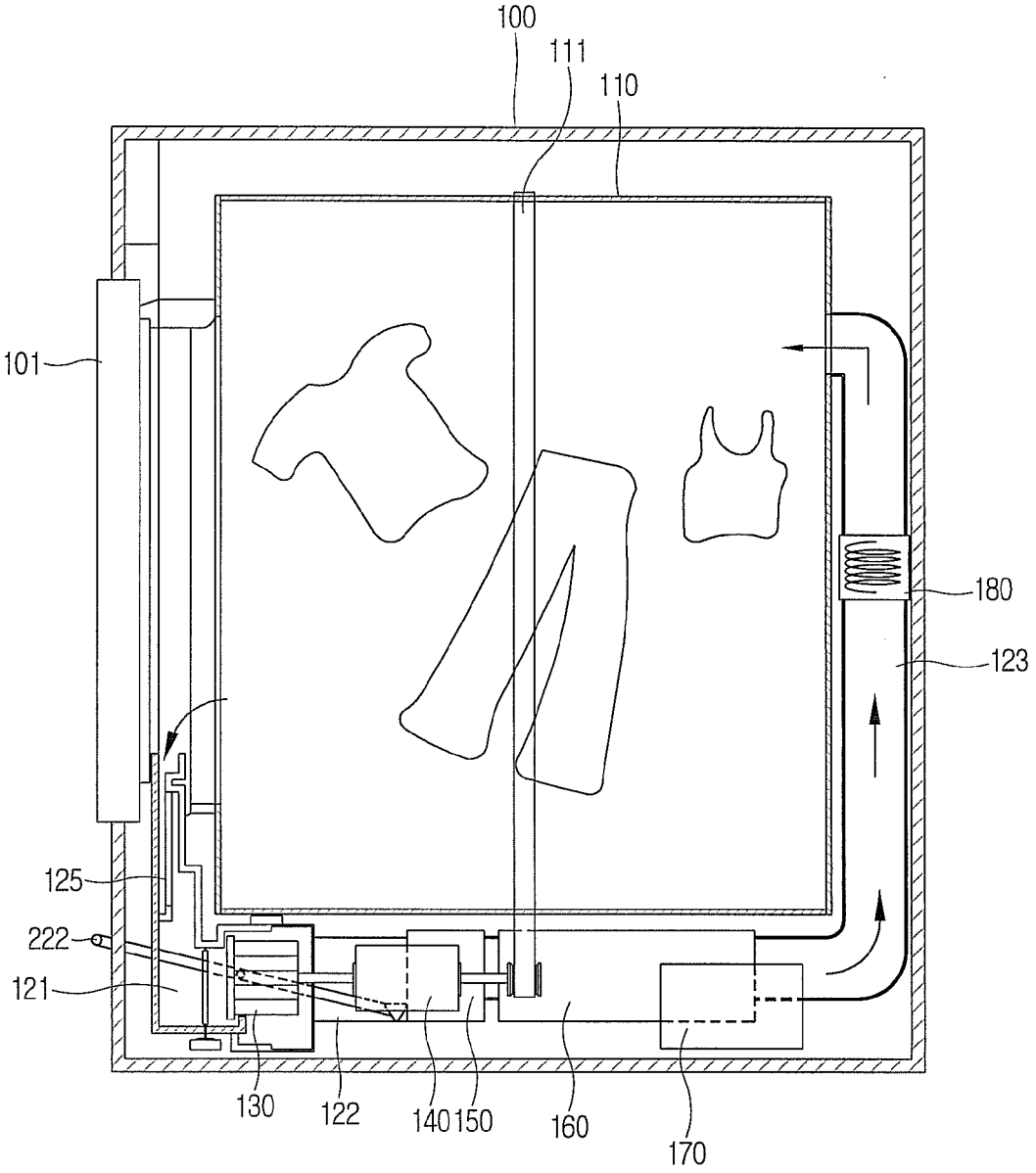
FIG. 2 is a sectional view taken along line I-I of FIG. 1.

Referring to FIG. 2, the drum 110 may be rotatably installed in the cabinet 100, and accommodate the laundry which is to be dried therein. The drum 110 may be rotatably supported in the cabinet 100 by supporters, for example, at front and rear ends of the drum 110.

The drum 110 may be connected to a driving motor 140 located in a lower portion of the dryer via a driving force transfer belt 111, so as to receive a rotational force. The driving motor 140 may have a pulley at one side thereof, and the pulley may be connected with the driving force transfer belt 111 for driving the drum 110.

A third pipe 123 which defines a passage (channel) for air to be introduced into the drum 110 may be installed at the rear of the drum 110. The air flowing through the third pipe 123 may be introduced into the drum 110 in response to rotation of a blower fan 130.

A first pipe 121 through which air may be discharged from the drum 110 after being used for drying may be installed at a front lower side of the drum 110. A filter 125 for filtering foreign materials, such as lint and the like, contained in the air discharged from the drum 110, may be installed in the first pipe 121.

Figure 3:
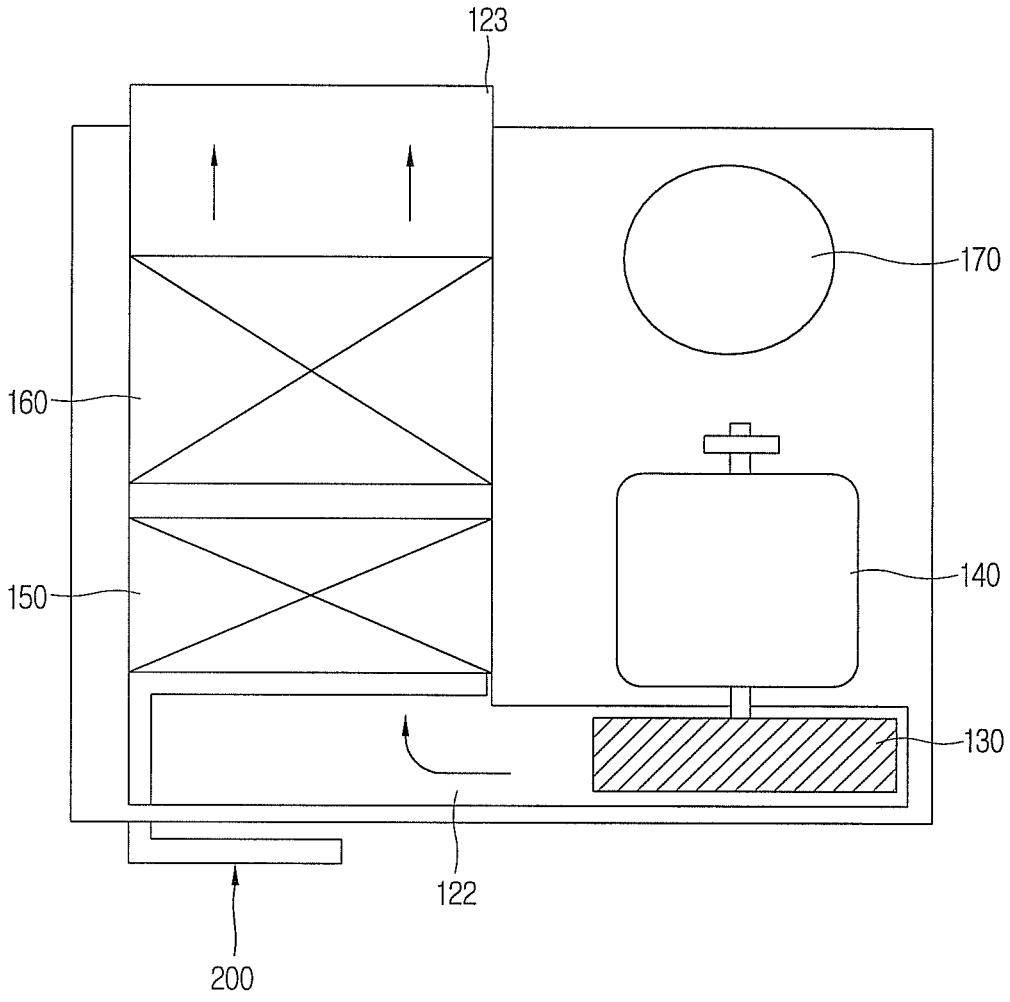
FIG. 3 is a sectional view taken along line II-II of FIG. 1.

The blower fan 130 may be installed in the first pipe 121 to allow hot humid air discharged from the drum 120 to flow toward an evaporator 150 serving as a type of heat exchanger. The blower fan 130 may also allow air to circulate along an air passage defined by the first pipe 121, a second pipe 122 and the third pipe 123. The second pipe 122 may form an air passage between the blower fan 130 and the evaporator 150. The blower fan 130 may be installed at an incline toward a lateral side surface of the cabinet 100, as shown in FIG. 3. Taking into account a space occupied by the drum 110, the blower fan 130 may be installed at an incline toward a side below the drum 110. The second pipe 122 may be installed below the front surface of the drum 110.

The evaporator 150 may form a heat pump together with a condenser 160, a compressor 170 and an expansion apparatus. The heat pump may allow for circulation of refrigerant so as to cool hot air, dehumidify the air and heat the air again. In detail, the evaporator 150 may cool hot humid air, supplied through the second pipe 122, to remove moisture from the air. Condensed water which is generated as the evaporator 150 removes moisture from the air may be collected below the evaporator 150 and then discharged to the outside. The evaporator 150 may include a plurality of radiation fins 152 arranged so as to overlap and be spaced apart from each other, and a refrigerant pipe 153 penetrating through the radiation fins 152. The evaporator 150 may further include a case 151 fixing a position of the radiation fins 152 and forming an external appearance of the evaporator 150. The plurality of radiation fins 152 may overlap each other and be arranged in parallel so as to define a channel through which air flows.

A refrigerant circulating through the heat pump may receive heat from the hot air in the evaporator 150, compressed in the compressor 170, and supplied into the condenser 160. As aforementioned, the air from which moisture has been removed in the evaporator 150 may be introduced into the condenser 160, heated by the refrigerant and then re-introduced into the drum 110 through the third pipe 123. The refrigerant cooled in the condenser 160 may be supplied back to the evaporator 160 through the expansion apparatus, so as to circulate through the heat pump.

A heater 180 may be installed in the third pipe 123 to further heat air when full heating or fast heating is not achieved only by the condenser 160. The air which has been heated sequentially through the condenser 160 and the heater 180 may be introduced into the drum 110 to dry the laundry. As such, hot air may be supplied into the drum 110 by use of both the heat pump and the heater 180, which may shorten a drying time.

Consequently, hot air may be supplied by the heat pump in a circulating manner, which may result in improvement of energy efficiency during a drying process. That is, heat energy contained in air discharged from the drum 110 may be partially transferred to the refrigerant in the evaporator 150, and the partial heat energy may be reused to heat air in the condenser 160, thereby reducing energy consumption.

The present disclosure is not limited to such a circulating type dryer, and may also be applicable to a dryer which discharges air dehumidified in the evaporator 150 directly to the outside.

Figure 4:
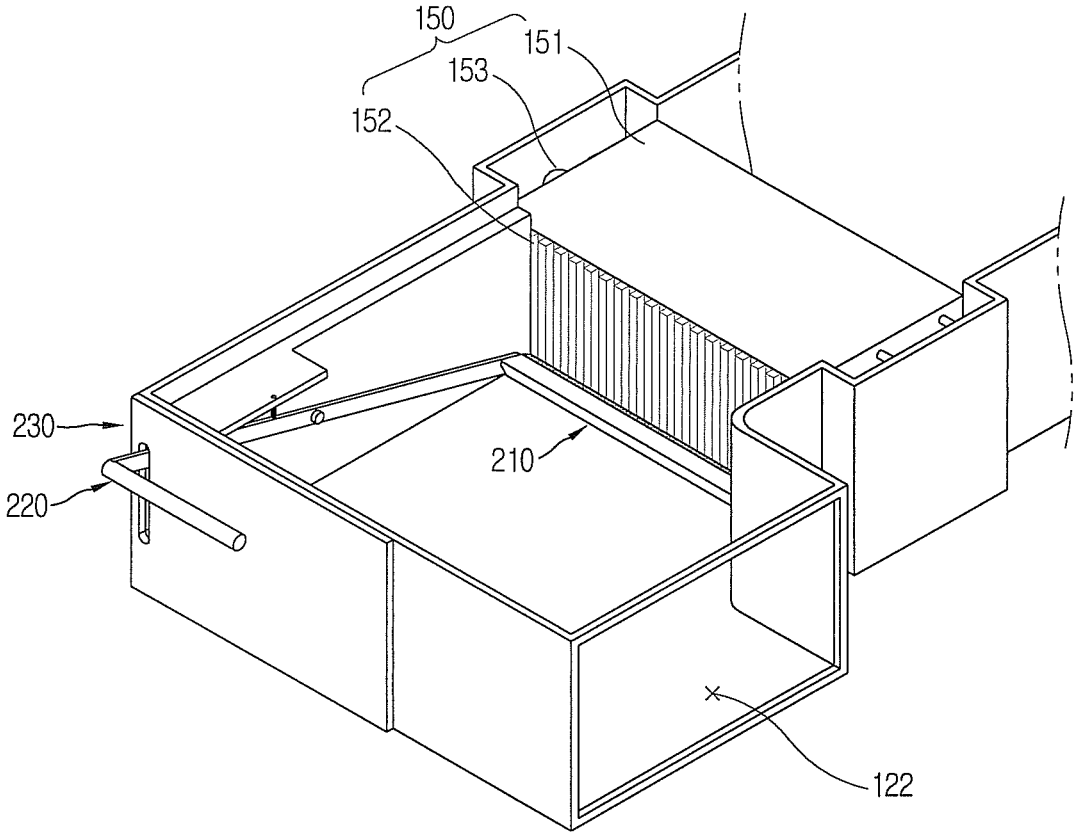
FIG. 4 is a partial perspective view of an air passage and a cleaning device shown in FIG. 3.
Figure 5:
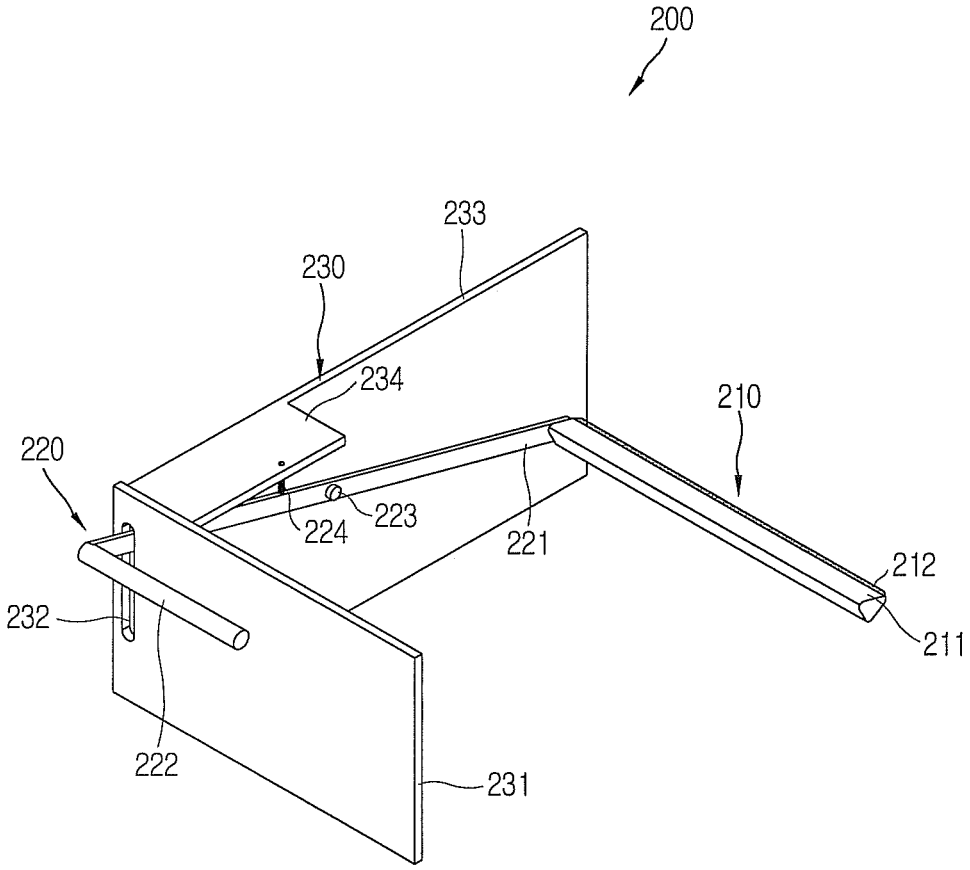
FIG. 5 is a perspective view of the cleaning device shown in FIG. 4.

FIG. 5 is a perspective view of the cleaning device shown in FIG. 4. Hereinafter, a cleaning device 200 will be described in detail with reference to FIGS. 1 to 5.

The cleaning device 200 may be installed at the second pipe 122 connected to a front surface of the evaporator 150. The cleaning device 200 may include a lint removing device 210, an operating device 220 and a supporting device 230.

The lint removing device 210 may come in contact with an air inlet of the evaporator 150, namely, the front surface of the evaporator 150, receive an external force transferred by the operating device 220, and remove foreign materials such as lint and the like while repetitively moving up and down along the fins 152. The lint removing device 210 may include a brush supporter 211 and a brush 212. The brush 212 may be fixed onto the brush supporter 211 and face the front surface of the evaporator 150. The brush supporter 211 may extend in a horizontal direction of the front surface of the evaporator 150.

The operating device 220 may be rotated by a predetermined angle when an external force is applied downwardly, so as to move the lint removing device 210. The operating device 220 may include a connection rod 221, a manipulation portion 222, or handle 222, a hinge 223 and a spring 224.

One end of the connection rod 221 may be connected to one end of the brush supporter 211, and the other end thereof may extend toward the front of the cabinet 100. The connection rod 221 may have a bar shape having, for example, a square or rectangular cross section. The connection rod 221 is not limited to this shape. The connection rod 221 may have a cylindrical bar shape or other various shapes.

The manipulation portion 222 may be connected to the other end of the connection rod 221, and may receive a manual manipulation or an external force applied by a mechanical force. The manipulation portion 222, as shown in FIG. 1, may be exposed to the outside of the cabinet 100, and have a shape that the user may easily grip. For example, the manipulation portion 222 may extend in a horizontal direction and have a somewhat uneven surface. In certain embodiments, at least part of the manipulation portion 222 may be made of a flexible material to improve the feeling of the grip. As an external force is downwardly applied to the manipulation portion 222, the lint removing device 210 may be moved upwardly.

The hinge 223 may rotatably couple the connection rod 221 to the supporting device 230. The hinge 223 may be installed on a middle portion of the connection rod 221. When an external force is applied to the manipulation portion 222, the connection rod 221 may be rotated by a predetermined angle based on the hinge 223 and cooperatively the lint removing device 210 may be moved upwardly.

The spring 224 may be connected to the connection rod 221 to generate a restoring force opposite the direction in which the external force is applied. In detail, the spring 224 may have one end fixed to an upper end of the supporting device 230, and the other end fixed to the connection rod 221 at a position adjacent to the manipulation portion 222. Therefore, at an initial position at which an external force is not applied to the manipulation portion 222, as shown in FIG. 5, an end of the connection rod 221 which is connected to the manipulation portion 222 may be positioned higher than an end thereof connected to the lint removing device 210. Therefore, the lint removing device 210 may be located at a lower end of the front surface of the evaporator 150 at the initial, or at rest, position. Here, an element for applying an elastic force is not limited to the spring 224. For example, the elastic force may be generated by a torsion spring on the hinge 223 or a compression spring at a position opposite that of the spring 224, instead of the spring 224.

With the aforementioned configuration, a user may remove lint from the outside of the laundry treatment apparatus by handling the manipulation portion 222 simply in a manual manner or using a mechanical force. Also, the lint removing device 210 may be moved from the initial position by an external force and then restored to the initial position by an elastic force of the spring 224 without an external force.

The operating device 220 may also be restored to the initial position in response to an external force being applied to the manipulation portion 222, without the elastic force provided by a separate element.

The supporting device 230 at which the operating device 220 is installed may support both the operating device 220 and the lint removing device 210. The supporting device 230 may include a first supporting plate 231, a through hole 232, a second supporting plate 233, a spring fixing portion 234 and a sealing member.

The first supporting plate 231 may be a plate which is coupled to the front surface of the cabinet 100 to define a front external surface together with the cabinet 100. The first supporting plate 231 may be coupled to the second pipe 122 so as to form the air passage together with the second pipe 122. However, the present disclosure is not limited to this. The first supporting plate 231 may be assembled only to the second pipe 122, without being assembled to the cabinet 100. The first supporting plate 231 may have a rectangular shape with a predetermined thickness. The through hole 232 may be formed through the first supporting plate 231. The through hole 232 may be a hole through which the connection rod 221 extends. The through hole 232 may extend in a longitudinal direction. A length of the through hole 232 in the longitudinal direction may be sufficient to provide an appropriate rotation angle of the connection rod 221. The through hole 232 may be as wide as the connection rod 221, which movable along the through hole 232. The sealing member may also be provided in the through hole 232 to fill a gap between the through hole 232 and the connection rod 221 to prevent leakage of air. The sealing member may be made of a rubber material having a central portion cut off in a horizontal direction.

The second supporting plate 233 may be connected to one end of the first supporting plate 231 and oriented perpendicular to the first supporting plate 231. The hinge 223 may be fixed to the second supporting plate 223. The second supporting plate 233 may be a rectangular plate having a predetermined thickness and may be inserted into the second pipe 122. The spring fixing portion 234, as shown, may extend from one side of an upper end of the second supporting plate 233. One end of the spring 224 may be fixed to the spring fixing portion 234.

When so configured, the cleaning device 200 implemented as a single module in this manner may be detachably mounted onto the lower portion of the front surface of the cabinet 100, namely, the portion where the second pipe 122 is connected to the evaporator 150. This may allow the cleaning device 200 to be detached for repair, and reattached after repair.

Figure 6:
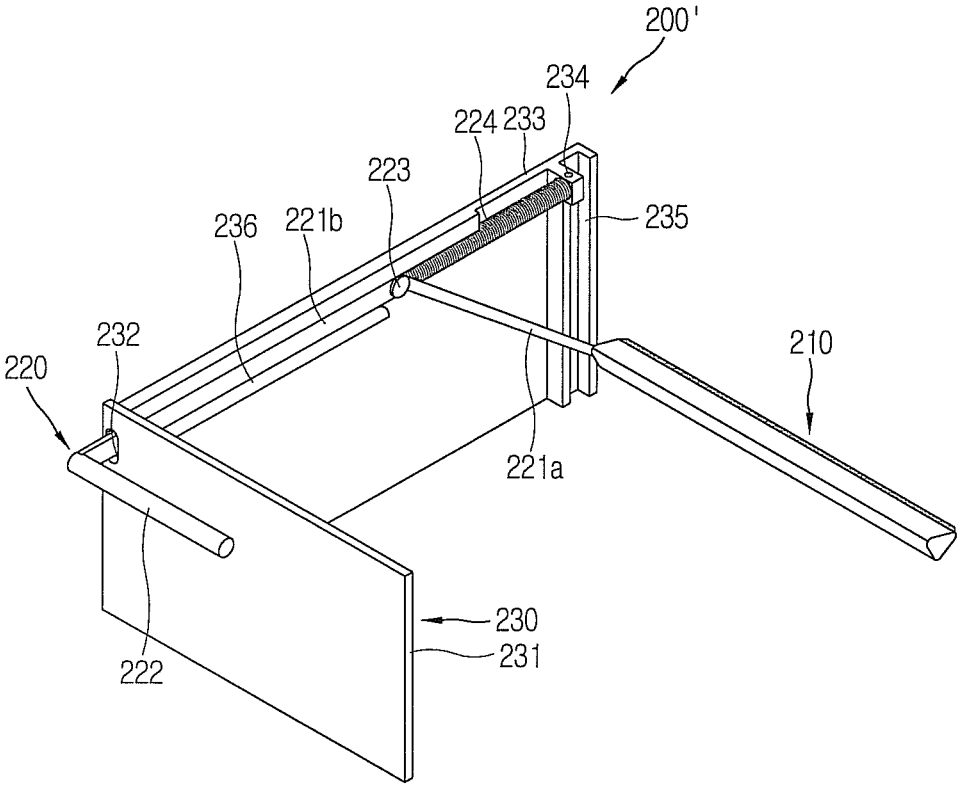
FIG. 6 is a perspective view of a cleaning device according another embodiment as broadly described herein.

FIG. 6 is a perspective view of a cleaning device 200' according to another exemplary embodiment, including a lint removing device 210, an operating device 220 and a supporting device 230. The configuration and function of the lint removing device 210 are substantially the same as those of the previous exemplary embodiment, so description thereof will be omitted.

The operating device 220 may be connected to the lint removing device 210 and may move the lint removing device 210 by an external force. The operating device 220 may include a first connection rod 221*a*, a second connection rod 221*b*, a manipulation portion 222, a hinge 223 and a spring 224.

The first connection rod 221*a* and the second connection rod 221*b* may be bars, which have the same shape as the aforementioned connection rod 221 but have different lengths from the connection rod 221. The first connection rod 221*a* and the second connection rod 221*b* may be rotatably connected to each other by the hinge 223. The first connection rod 221*a* may have one end connected to one end of the lint removing device 210, and the second connection rod 221*b* may have one end connected to the manipulation portion 222. The manipulation portion 222, as shown, may be exposed to the outside, and may have the same shape as that of the cleaning device 200 shown in FIG. 4. As the manipulation portion 222 is pulled by a user or a mechanical force in an axial direction of the second connection rod 221*b*, the lint removing device 210 may be moved upward along the front external surface of the evaporator 150.

The spring 224 may have one end connected to the second connection rod 221*b* or the hinge 223 and the other end connected to the supporting device 230, so as to provide an elastic force for restoring the lint removing device 210 to an initial position.

The supporting device 230, at which the operating device 220 is installed, may support both the operating device 220 and the lint removing device 210. The supporting device 230 may include a first supporting plate 231, a through hole 232, a second supporting plate 233, a spring fixing portion 234, a first guide 235, a second guide 236 and a sealing member.

The first supporting plate 231 may have substantially the same configuration and function as the first supporting plate 231 shown in FIG. 4, except for a shape of the through hole 232 formed through the first supporting plate 231. The through hole 232 may allow the second connection rod 221*b* to be inserted therethrough. The through hole 232 may have a size which is the same or slightly greater than a size of a section of the second connection rod 221*b*. The sealing member may be filled in a gap between the second connection rod 221*b* and the through hole 232. The sealing member may be made of a rubber or sponge material.

The second supporting plate 233 may be connected to one end of the first supporting plate 231 and oriented perpendicular to the first supporting plate 231, and may include the spring fixing portion 234, the first guide 235 and the second guide 236. The spring fixing portion 234 may protrude from an upper end of an edge of the second supporting plate 233, which is adjacent to the evaporator 150. Accordingly, one end of the spring 224 may be fixed to the spring fixing portion 234. The first guide 235 which guides the lint removing device 210 to be movable up and down may have a shape of a rail. One end of the brush supporter 210 may protrude to be coupled to the first guide 235 or one end of the first connection rod 221*a* may protrude to be coupled to the first guide 235. The second guide 236 which guides the second connection rod 221*b* to be movable in a horizontal direction may have a shape of a rail. The second connection rod 221*b* may be inserted to be movable on the rail of the second guide 236. The first and second guides 235 and 236 are not limited to those shapes, and may be varied in shape as appropriate.

Figure 7:
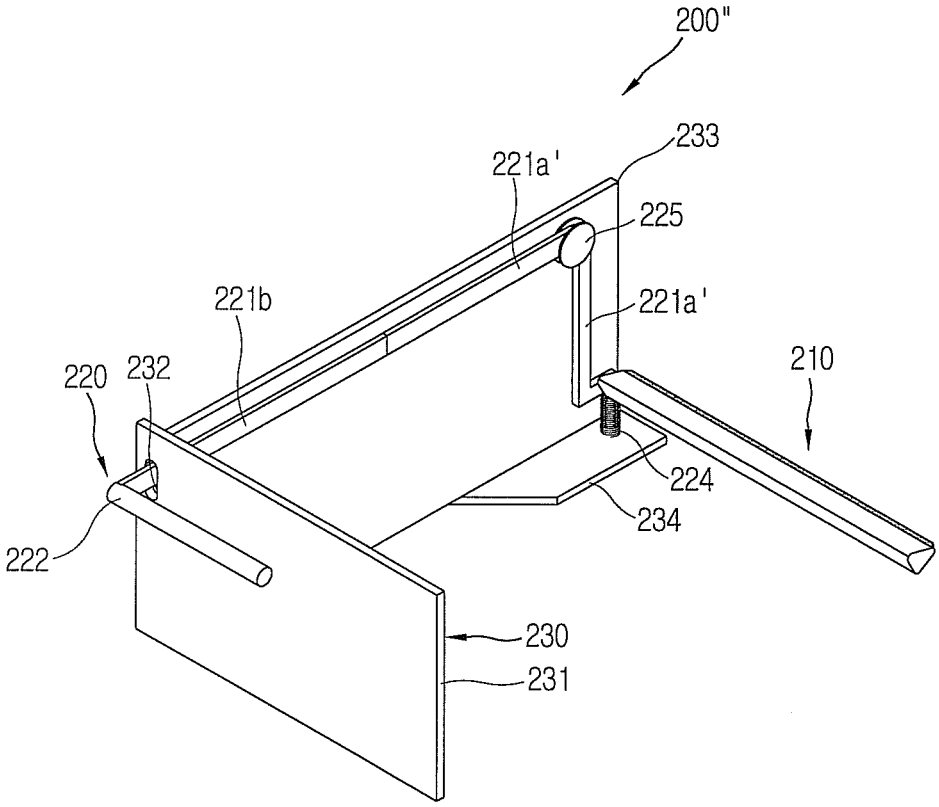
FIG. 7 is a perspective view of a cleaning device according another embodiment as broadly described herein.

FIG. 7 is a perspective view of a cleaning device in accordance with another embodiment, which will be described in detail with reference to FIGS. 1 to 7.

The cleaning device 200" shown in FIG. 7 may include a lint removing device 210, an operating device 220 and a supporting device 230. The lint removing device 210 may have substantially the same configuration and function as those of the cleaning devices 200, 200' of the previous exemplary embodiments, so description thereof will be omitted.

The operating device 220 may be connected to the lint removing device 210 and move the lint removing device 210 by an external force. The operating device 220 may include a first connecting rod 221*a*', a second connection rod 221*b*, a manipulation portion 222, a spring 224 and a roller 225. The first connection rod 221*a*' may have one end connected to the lint removing device 210 and the other end connected to the second connection rod 221*b*. The first connection rod 221*a*' may be guided by the roller 225 and be bent perpendicularly about the roller 225. The first connection rod 221*a*' may be made of a rubber material. The second connection rod 221*b* may have substantially the same shape as the second connection rod 221*b* shown in FIG. 6. The second connection rod 221*b* may have one end connected to the first connection rod 221*a*' and the other end connected to the manipulation portion 222. The manipulation portion 222 may move the lint removing device 210 upward in response to an external force applied thereto in the same direction as that applied to the manipulation portion 222 shown in FIG. 6.

The spring 224 may have one end connected to the lint removing device 210 and the other end connected to a lower end of the supporting device 230, to provide an elastic force to a lower side of the lint removing device 210. The roller 225 may be rotatably fixed to the supporting device 230.

The supporting device 230, at which the operating device 220 is installed, may support both the operating device 220 and the lint removing device 210. The supporting device 230 may include a first supporting plate 231, a through hole 232, a second supporting plate 233, a spring fixing portion 234 and a sealing member. The first supporting plate 231, the through hole 232 and the sealing member may have substantially the same configuration and function as those described with reference to FIG. 6.

The second supporting plate 233 may be connected to one end of the first supporting plate 231 and oriented perpendicular thereto. The roller 225 may be rotatably fixed to the second supporting plate 233. The second supporting plate 233 may be a rectangular plate with a predetermined thickness and inserted into the second pipe 122. The spring fixing portion 234, as shown in FIG. 7, may extend from a portion of a lower end of the second supporting plate 233, adjacent to the lint removing device 210, so as to fix the spring 224.

The aforementioned cleaning devices according to the exemplary embodiments are not necessarily limited to the components specifically described. For example, various different configurations may be employed if the lint removing device 210 is moved along the leading edges of the radiation fins 152 overlapping each other in response to an external force being applied.

Figure 8:
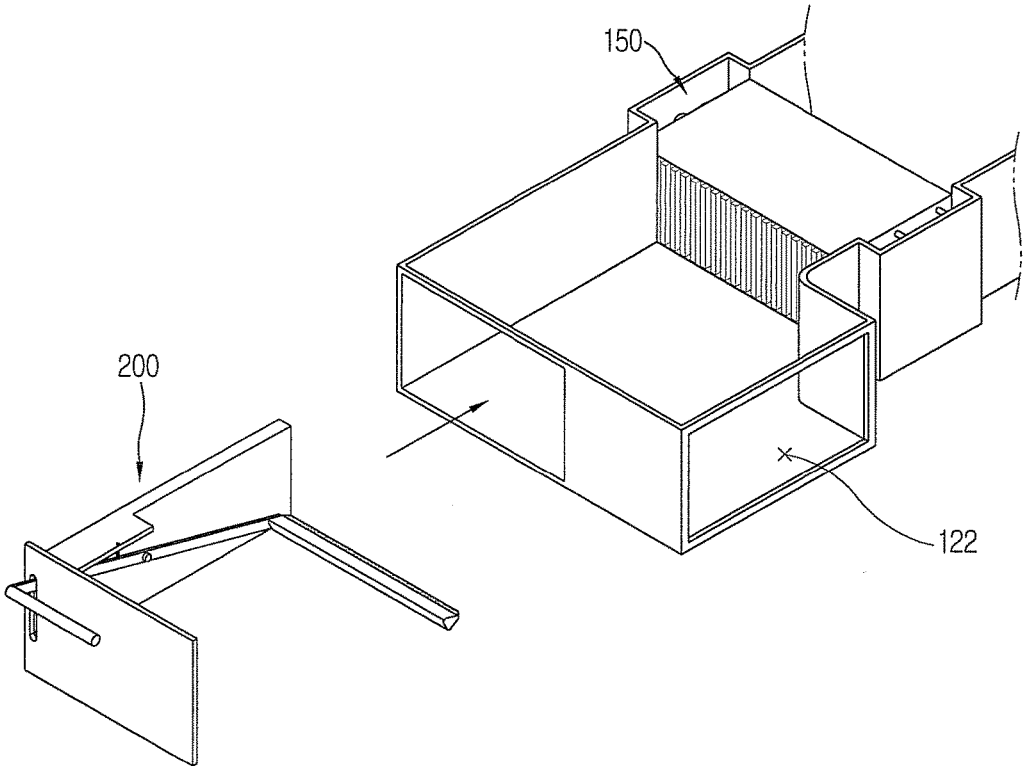
FIG. 8 is a partial perspective view of the cleaning device shown in FIG. 4 mounted in an air passage.

A method of mounting the cleaning device 200 according to the embodiment shown in FIG. 4 will be described in detail with reference to FIG. 8.

The cleaning device 200 implemented as a single module may be installed in the second pipe 122 such that the lint removing device 210 faces the front surface of the evaporator 150. As shown in FIG. 8, the second pipe 122 may include an opening on the front surface of the cabinet 100 such that the cleaning device 200 may be inserted therethrough. Accordingly, the second supporting plate 233 may be inserted through the opening of the second pipe 122 with one end thereof facing the evaporator 150. The first supporting plate 231 may close the opening at the front of the cabinet so as to form an air passage together with the second pipe 122, and be coupled to the second pipe 122 such that the cleaning device 200 may be installed in the air passage, upstream of the evaporator 150.

As such, the installation of the cleaning device 200 may be facilitated since the single module is cleaning device 200 mounted at the front surface of the evaporator 150, and maintenance and repair of the cleaning device 200 may be simplified because the cleaning device 200 may be detached integrally.

Figure 9:
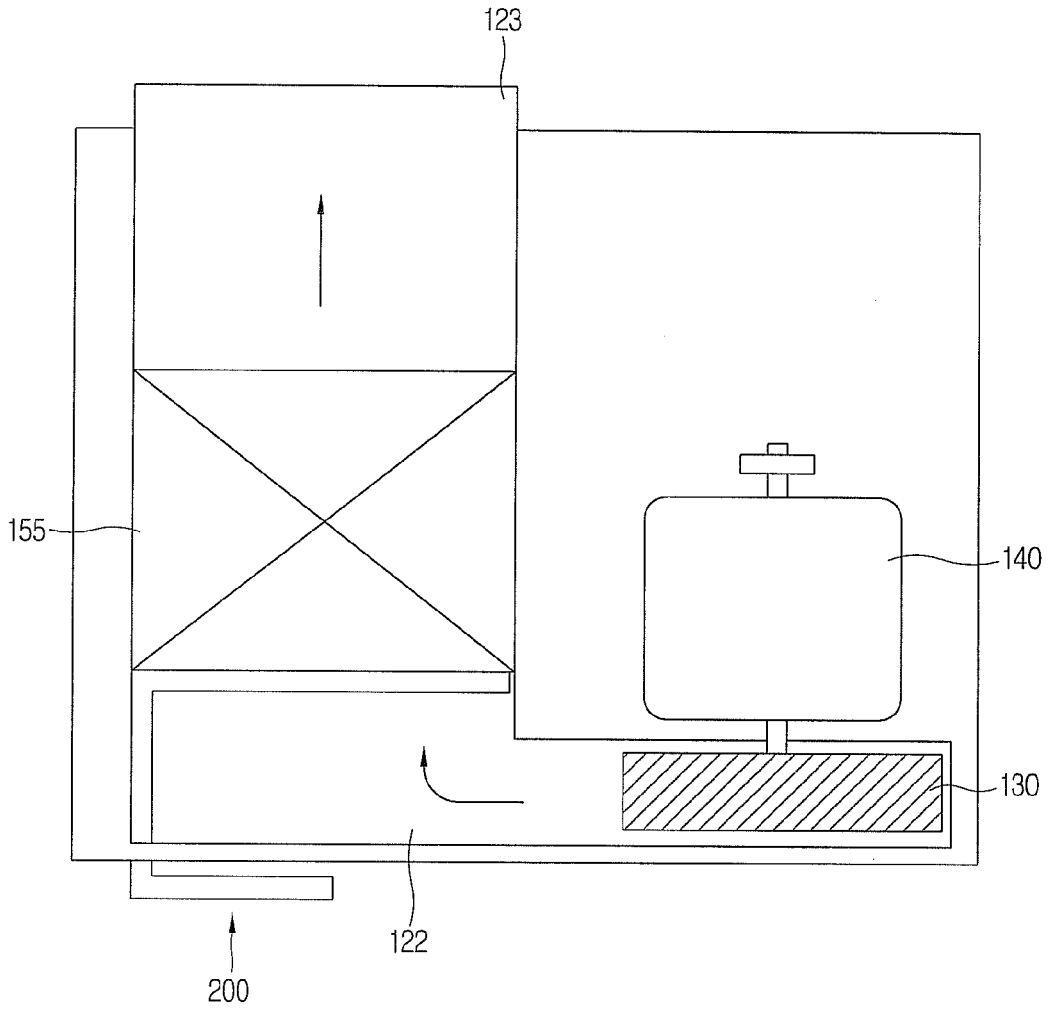
FIG. 9 is a top schematic view of a lower structure of a laundry treating apparatus in accordance with another embodiment as broadly described herein.

FIG. 9 is a planar view of a lower structure of a laundry treating apparatus in accordance with another exemplary embodiment. The exemplary embodiment shown in FIG. 9 includes a water-cooled heat exchanger 155, instead of the heat pump, to dehumidify air transferred from the drum 110. The cleaning device 200 having the aforementioned configuration may be disposed at an air inlet of the water-cooled heat exchanger 155, namely, at a front surface of the water-cooled heat exchanger 155 so as to remove lint and the like accumulated on the water-cooled heat exchanger 155. Air dehumidified through the water-cooled heat exchanger 155 may be resupplied to the drum 110 through the third pipe 123 by the blower fan 130. The cleaning device 200 may have the same configuration as those previously described with reference to FIGS. 5 to 8, so description thereof will be omitted. In alternative embodiments, the dehumidified air may be through the third pipe 123.

Figure 10:
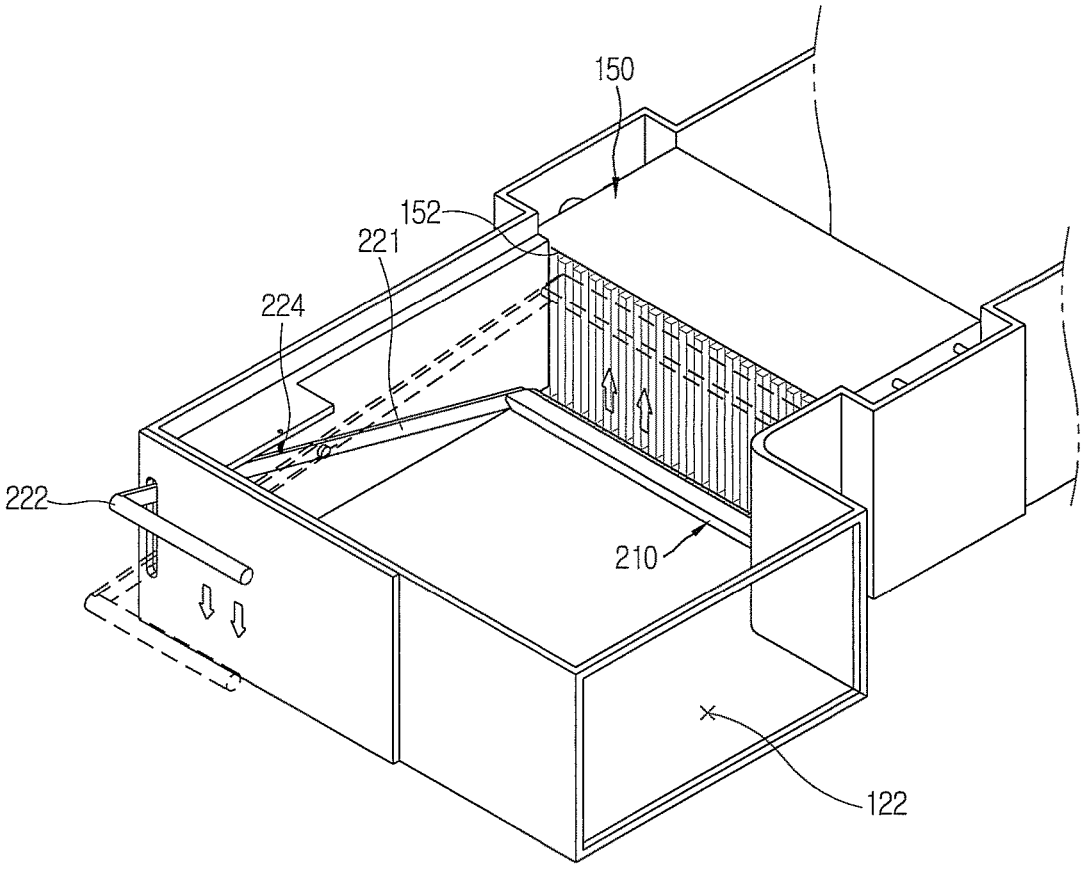
FIG. 10 is a perspective view of a used state of the cleaning device shown in FIG. 4.

FIG. 10 is a perspective view of the cleaning device shown in FIG. 4, in use. A method of using a cleaning device in a laundry treating apparatus according to one exemplary embodiment will be described in detail with reference to FIG. 10. First, the manipulation portion 222 may be pushed down, for example, by a force which is manually applied by the user, or by a mechanical force. When the manipulation portion 222 is moved down, the connection rod 221 may be rotated by a predetermined angle about hinge 223. This may allow the lint removing device 210 to be moved along the leading edges of the radiation fins 152. Since the radiation fins 152 are aligned in a vertical direction, the lint removing device 152 may be moved upward. Accordingly, the brush 212 may contact the front surface of the evaporator 150 so as to physically remove foreign materials such as lint and the like. When the manipulation portion 222 is pushed down to a bottom of the through hole 232, the lint removing device 210 may be moved up to a top of the front surface of the evaporator 150 to remove the lint. Afterwards, when an external force is no longer applied to the manipulation portion 222, the lint removing device 210 may be restored to its initial position by an elastic force of the spring 224. Condensed water which has been generated during dehumidification of air may be collected below the evaporator 150. The brush 212 may be positioned near or submerged in the condensed water at the initial position, so that foreign materials, such lint and the like, stuck on the brush 212 may be washed off. The condensed water containing the foreign materials may then be discharged.

Figure 11A:
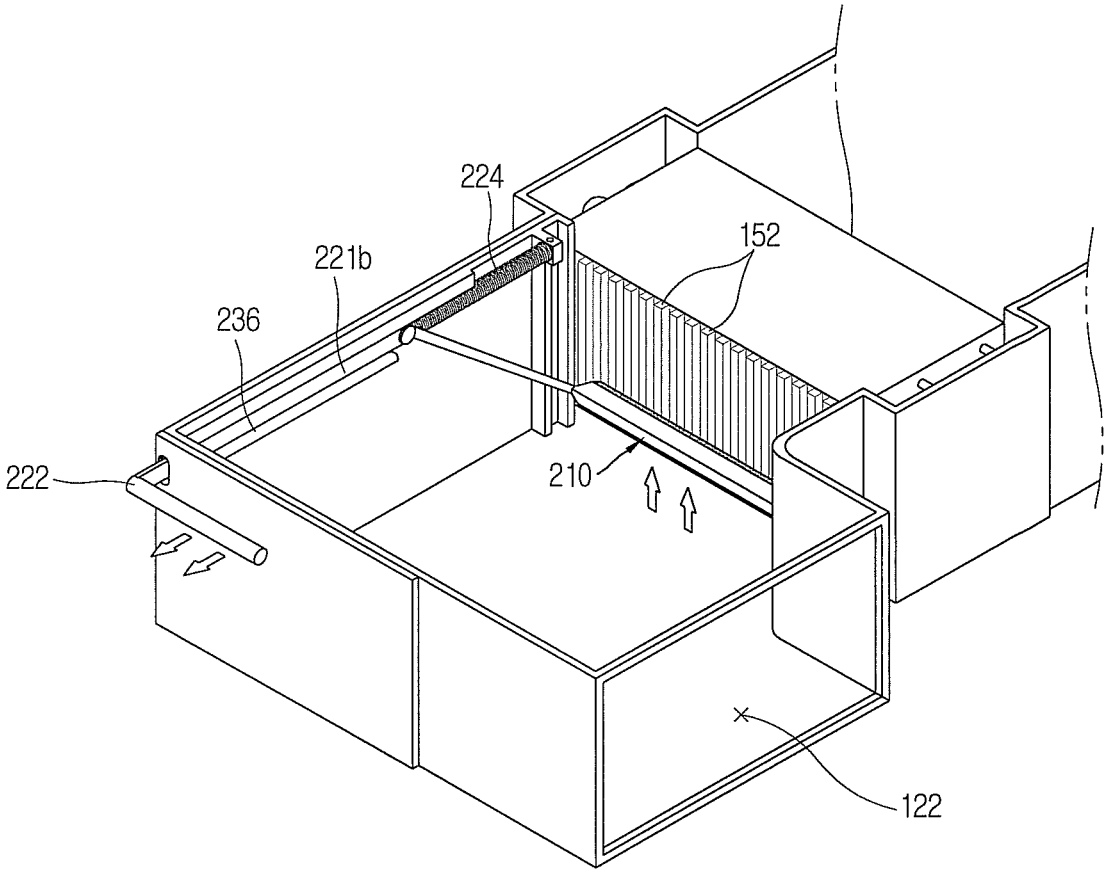
FIGS. 11A and 11B are perspective views of the cleaning device shown in FIG. 5 in use, where
Figure 11B:
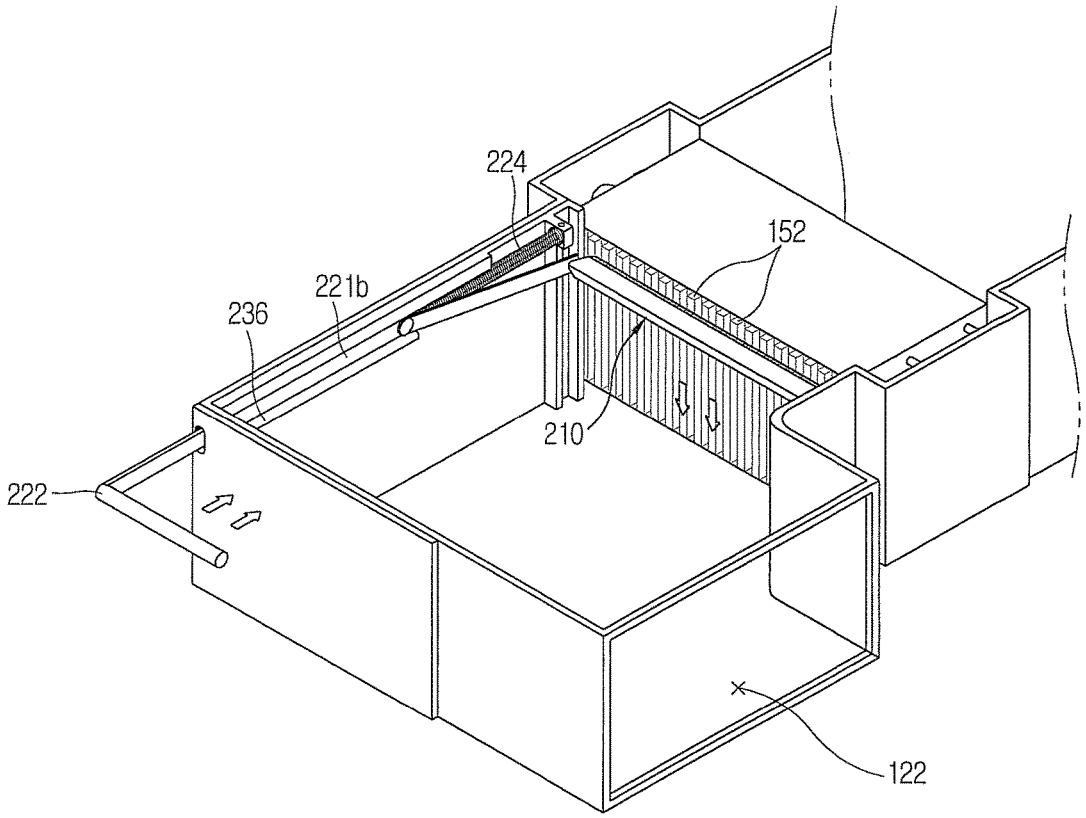

FIGS. 11A and 11B are perspective views of the cleaning device shown in FIG. 5 in use. First, the manipulation portion 222 may be pulled outward by a mechanical force or in a manual manner. When the manipulation portion 222 is pulled, the second connection rod 221*b* may be moved along the second guide 236, and the lint removing device 210 may be moved along the first guide 235 up to the top of the front surface of the evaporator 150 in a perpendicular direction to a line of action of an external force. As such, the lint removing device 210 may be moved to the top of the evaporator 150 along the leading edges of the radiation fins 152. After removing the lint, the lint removing device 210 may be stopped at a top of the guide 235 and no longer moved. When an external force is not applied to the manipulation portion 222, the lint removing device 210 may be restored to the initial position by the elastic force of the spring 224. The brush 212 of the lint removing device 210 may be positioned in condensed water collected below the evaporator 150 in the initial position, so that foreign materials such as lint and the like may be washed off by the condensed water. The condensed water containing the foreign materials may then be discharged.

Figure 12A:
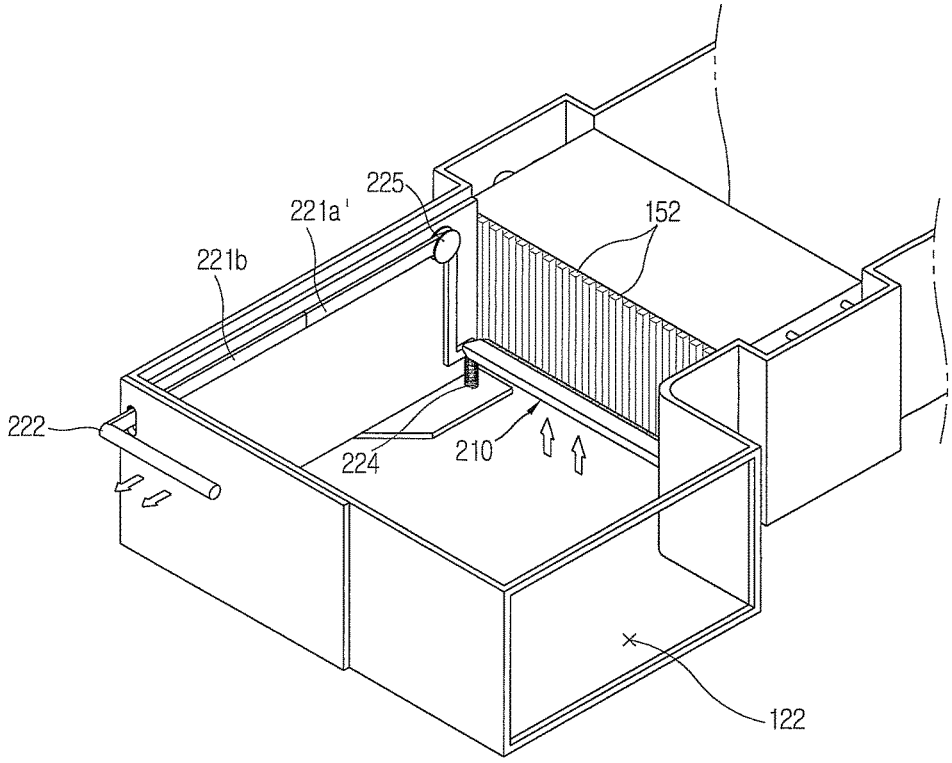
FIGS. 12A and 12B are perspective views of f the cleaning device shown in FIG. 6 in use, where
Figure 12B:
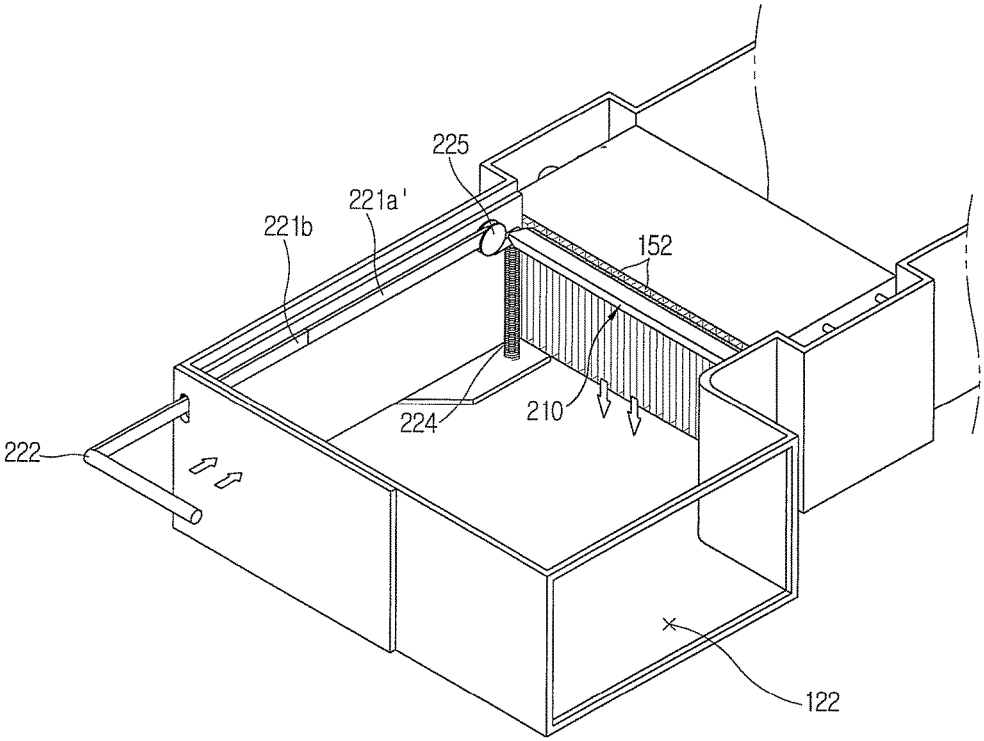

FIGS. 12A and 12B are perspective views of the cleaning device shown in FIG. 6 in use. First, the manipulation portion 222 may be pulled outward by a mechanical force or in a manual manner. In response to the manipulation portion 222 being pulled, the second connection rod 221*b* may be moved and a moving direction of the first connection rod 221*a*' may be switched by the roller 225. Accordingly, the lint removing device 210 may be pulled in a perpendicular direction to a line of action of the eternal force. The lint removing device 210 may thus remove lint from the front surface of the evaporator 150 while moving upward along the leading edges of the radiation fins 152 until being stopped by the roller 225. Afterwards, when an external force is no longer applied to the manipulation portion 222, the lint removing device 210 may be restored to the initial position by the elastic force of the spring 224. The brush 212 of the lint removing device 210 may be positioned in condensed water collected below the evaporator 150 in the initial position, and accordingly foreign materials such as lint and the like may be washed off by the condensed water. The condensed water containing the foreign materials may then be discharged.

A laundry treating apparatus is provided, having an improved drying performance by simply removing foreign materials, such as lint and the like, accumulated on a heat exchanger installed in the laundry treating apparatus.

A laundry treating apparatus is provided having a cleaning device configured as one module to be integrally detachable from the laundry treating apparatus.

A laundry treating apparatus as embodied and broadly described herein may include a cabinet, a drum rotatably installed in the cabinet, a heat exchanger disposed in the cabinet and configured to cool air transferred from the drum, and a cleaning device disposed in the cabinet and driven by an external force to remove lint stuck on the heat exchanger.

The cleaning device may have one end exposed to an outside of the cabinet to be manipulated at the outside. This structure may not require a separate device for applying an external force within the cabinet, thereby simplifying the configuration of the cleaning treating apparatus.

The heat exchanger may include a plurality of radiation fins aligned in an overlapping manner to allow for the flow of air. The cleaning unit may scratch off lint while moving along grains of the overlapped radiation fins.

The cleaning device may remove the lint by being moved as an applying direction of the external force is switched. The cleaning device may remove the lint as it is rotated by the external force by a predetermined angle and then moved in one direction or as it is moved perpendicular to a line of action of the external force.

The cleaning device may remove the lint while moving up and down along the grains of the radiation fins, and the lint may be collected below the heat exchanger. The lint removed by the cleaning device may be discharged to the outside together with condensed water which is generated while cooling air transferred from the drum. With the configuration, the removed lint may be discharged through a discharge hole of the condensed water. Therefore, a separate device for discharging the lint may not be required.

The cleaning device may be restored to the initial position by an elastic force, or by applying an external force in a different direction.

A treating apparatus in accordance with another embodiment may include a heat pump. The heat pump may include a circulating refrigerant, an evaporator and a condenser to heat air supplied into the drum. The heat exchanger may be used as the evaporator. The heat pump may also include a compressor to compress the refrigerant, and an expansion apparatus to expand the refrigerant.

A passage through which air is transferred to the evaporator may be disposed at a lower side of a front surface of the drum.

The cleaning device may be assembled by being integrally inserted into a lower space of the cabinet. The cleaning device may be inserted into an upstream side air passage of the evaporator. With this configuration, the cleaning device may be implemented as one component to be simply assembled to the cabinet. Also, the cleaning device may be easily detached from the cabinet, which may facilitate maintenance and repair of the cleaning device.

A laundry treatment apparatus in accordance with another embodiment as broadly described herein may include a cabinet, a drum rotatably installed in the cabinet, a heat pump having an evaporator to cool air transferred from the drum, and a cleaning device installed in an air passage toward the evaporator to remove lint. The cleaning device may include a lint removing unit to remove lint collected on the evaporator, and an operating unit partially exposed to an outside of the cabinet and moving the lint removing unit in response to an external force.

The heat pump may also include a circulating refrigerant, a condenser to heat air supplied into the drum, a compressor to compress the refrigerant, and an expansion apparatus to expand the refrigerant.

The apparatus may also include a heater to heat air transferred from the condenser into the drum. This configuration may provide an effect of performing a drying operation faster than using only the heat pump.

The cleaning device may also include a supporting unit at which the operating unit is installed. The supporting unit may be assembled to a pipe forming an upstream side air passage of the evaporator so as to form the air passage together with the pipe, or may be assembled to the cabinet so as to form a part of an appearance of the clothes treating apparatus.

According to the aforementioned configuration, the cleaning device may be integrally assembled to the cabinet and the assembling may be achieved in a simplified manner. Also, the cleaning device may be easily detached from the apparatus, which may facilitate maintenance and repair of the cleaning device.

The operating unit may include a manipulation portion disposed at the outside of the cabinet and receiving an external force applied thereto, and a connection rod to connect the operating unit to the lint removing unit.

The external force applied to the manipulation portion may be transferred to the lint removing unit through the connection rod. A direction that the external force for moving the lint removing unit may be switched by use of a hinge or a roller.

The supporting unit may include a through hole through which the connection rod extends.

The supporting unit may also include a sealing member disposed in a gap between the connection rod inserted through the through hole and the through hole. Accordingly, the through hole may be sealed so as to prevent an introduction of foreign materials into the clothes treating apparatus and a leakage of air.

The supporting unit may also include a guide to guide at least one of the operating unit and the lint removing unit.

The operating unit may move the lint removing unit to the initial position by an elastic force. The operating unit may also include a spring having one end connected to the connection rod and restoring the lint removing unit to the initial position by the elastic force.

The lint removing unit may include a brush and a brush supporter to support the brush mounted thereto.

The brush supporter may extend across a surface of the evaporator with an air inlet.

In accordance with at least one exemplary embodiment as broadly described herein, foreign materials such as lint, which are collected on a heat exchanger, may be removed at an outside of the apparatus by a simple manipulation without removing a cover of the laundry treating apparatus.

In accordance with at least one exemplary embodiment as broadly described herein, a cleaning device may be simply manipulated from an outside of the apparatus if necessary.

In accordance with at least one exemplary embodiment as broadly described herein, the cleaning device may be implemented as a single module. This may facilitate detachment of the cleaning device from the laundry treating apparatus and maintenance of the cleaning device.

In accordance with at least one exemplary embodiment as broadly described herein, foreign materials such as lint may be removed by the cleaning device, which may result in improved drying performance of the laundry treating apparatus.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A clothes treating apparatus, comprising:

a cabinet;

a drum rotatably installed in the cabinet;

a heat exchanger provided in the cabinet and configured to cool air received from the drum;

an opening provided in a side surface of the cabinet that faces the heat exchanger; and a cleaning device configured to be inserted into or withdrawn through the opening so as to be detachably coupled to the cabinet and driven by an external force to remove debris accumulated on the heat exchanger, the cleaning device including:

a supporting device configured to cover the opening and having a through hole provided in a surface thereof that faces the heat exchanger;

a handle exposed to an outside of the cabinet to receive an external force manually applied thereto;

a cleaning end that makes contact with the heat exchanger and removes debris accumulated on the heat exchanger while moving in a predetermined direction; and a connection rod that passes through the through hole to connect the handle to the cleaning end and moves with the handle in response to the external force manually applied to the handle so as to move the cleaning end in the predetermined direction.

2. The apparatus of claim 1, wherein the connection rod is positioned within the cabinet and is configured to rotate in response to the external force manually applied to the handle.

3. The apparatus of claim 2, wherein the heat exchanger includes a plurality of sequentially aligned radiation fins that form an air passage, and wherein the cleaning end is configured to contact and move along leading edges of the plurality of radiation fins in response to the external force manually applied to the handle so as to remove the debris accumulated on the heat exchanger.

4. The apparatus of claim 1, wherein the handle, the connection rod, and the cleaning end are moved from an initial position in response to the external force manually applied to the handle thereof, and are restored to the initial position by an elastic force upon removal of the external force.

5. The apparatus of claim 1, wherein the cleaning end includes a brush coupled to a brush supporter.

6. The apparatus of claim 1, further comprising a hinge that rotatably couples the connection rod to the supporting device, wherein the connection rod is configured to rotate about the hinge in response to the external force manually applied to the handle, and the cleaning end moves in the predetermined direction opposite a direction of the external force as the cleaning end moves along leading edges of the radiation fins.

7. The apparatus of claim 1, further comprising at least one roller rotatably fixed to the supporting device, wherein the connection rod is configured to move in a first direction corresponding to the external force in response to application of the external force to the handle and is composed of an elastic material, wherein the roller is configured to switch a moving direction of the connection rod, and the cleaning end is configured to move in the predetermined direction perpendicular to the first direction, in response to the external force, as the cleaning end moves along leading edges of the radiation fins.

8. The apparatus of claim 1, further comprising a heat pump circulating refrigerant therethrough, the heat pump including an evaporator and a condenser to heat air supplied into the drum, wherein the heat exchanger is the evaporator.

9. The apparatus of claim 8, further comprising a heater provided in a duct that guides air from the heat exchanger to the drum, wherein the heater is positioned downstream of the heat exchanger to further heat air heated by the heat exchanger for supply to the drum.

10. The apparatus of claim 1, wherein the cleaning device is inserted into an air passage in which the heat exchanger is received, upstream of the heat exchanger.

11. A laundry treating apparatus, comprising:

a cabinet;

a drum rotatably installed in the cabinet;

a heat pump circulating refrigerant therethrough, the heat pump including a condenser to heat air to be supplied to the drum, and an evaporator to cool air transferred from the drum;

an opening provided in a side surface of the cabinet that faces the evaporator;

a heater to heat air transferred from the heat pump to the drum; and a cleaning device installed in an air passage, upstream of the evaporator, the cleaning device configured to be inserted into or withdrawn through the opening so as to be detachably coupled to the cabinet, and driven by an external force to remove debris accumulated on the evaporator, wherein the cleaning device includes:

a supporting device configured to cover the opening and having a through hole provided in a surface thereof that faces the evaporator;

a manipulation portion exposed to an outside of the cabinet to receive an external force manually applied thereto;

a lint moving device that makes contact with the evaporator and is configured to remove debris accumulated on the evaporator while moving in a predetermined direction; and a connection rod that passes through the through hole to connect the manipulation portion to the lint moving device and is configured to move with the manipulation portion in response to the external force manually applied to the manipulation portion so as to move the lint moving device in the predetermined direction.

12. The apparatus of claim 11, wherein the supporting device partially defines the air passage.

13. The apparatus of claim 11, wherein the evaporator is received in the air passage, and the supporting device is coupled to a pipe so as to form the air passage together with the pipe.

14. The apparatus of claim 11, wherein the connection rod is coupled to the supporting device by a hinge or a roller that moves the connection rod to move the lint removing device in a direction that is different than that of the external force manually applied to the manipulation portion.

15. The apparatus of claim 14, wherein the supporting device includes:

a first plate configured to cover the hole;

a second plate extended in a direction that is perpendicular to the first plate;

wherein the through hole is formed in the first plate, the connection rod is inserted through the through hole to connect the lint removing device to the manipulation portion and the hinge or roller couples the connection rod to the second plate; and a seal provided in the through hole, between the periphery of the through hole and the connection rod.

16. The apparatus of claim 11, wherein the manipulation portion exposed to the outside of the cabinet is a handle.

* * * * *